US006473057B2

(12) United States Patent
Monzon

(10) Patent No.: US 6,473,057 B2
(45) Date of Patent: Oct. 29, 2002

(54) LOW PROFILE SCANNING ANTENNA

(75) Inventor: Cesar Monzon, Plano, TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/725,878

(22) Filed: Nov. 30, 2000

(65) Prior Publication Data

US 2002/0089462 A1 Jul. 11, 2002

(51) Int. Cl.[7] ..... H01Q 15/02

(52) U.S. Cl. ..... 343/909; 343/754; 343/757; 343/766

(58) Field of Search ..... 343/700 MS, 753, 343/754, 757, 762, 766, 767, 770, 771, 778, 755, 909

(56) References Cited

U.S. PATENT DOCUMENTS

| | | | | | |
|---|---|---|---|---|---|
| 3,979,755 | A | | 9/1976 | Sandoz et al. | 343/754 |
| 4,125,841 | A | * | 11/1978 | Munk | 343/909 |
| 4,905,014 | A | * | 2/1990 | Gonzalez et al. | 343/909 |
| 5,103,241 | A | * | 4/1992 | Wu | 343/872 |
| 5,311,202 | A | * | 5/1994 | Popp et al. | 343/909 |
| 5,373,302 | A | * | 12/1994 | Wu | 343/781 CA |
| 5,864,322 | A | * | 1/1999 | Pollon et al. | 343/754 |
| 5,945,946 | A | | 8/1999 | Munger | 342/367 |
| 6,081,234 | A | | 6/2000 | Huang et al. | 343/700 |
| 6,218,978 | B1 | * | 4/2001 | Simpkin et al. | 342/5 |
| 6,396,441 | B2 | * | 5/2002 | Perrott et al. | 343/700 MS |

FOREIGN PATENT DOCUMENTS

| | | | | |
|---|---|---|---|---|
| JP | 63189001 A | * | 8/1988 | H01Q/1/06 |
| JP | 06334426 A | * | 12/1994 | H01Q/3/14 |

* cited by examiner

*Primary Examiner*—Don Wong
*Assistant Examiner*—Shih-Chao Chen
(74) *Attorney, Agent, or Firm*—Baker Botts L.L.P.

(57) ABSTRACT

A beam forming low profile scanning antenna system is provided comprising a radiating element (11) for radiating signals and a pair of panels (13 and 15) each having an array of phase-inducing transmitting resonant elements (21) on a pair of panels for focusing said radiating signals to produce radiated beams. The panels are rotated with respect to each other (17) to scan said beams.

9 Claims, 4 Drawing Sheets

LOW PROFILE SCANNING ANTENNA

BACKGROUND OF THE INVENTION

1. Technical Field of Invention

This invention relates to beam formation and scanning antennas and more particularly to 2D and 3D wide angle steering antenna systems.

2. Background of Invention

A need exists for an antenna possessing 2D and 3D wide angle steering capabilities for circular polarization operation, while possessing a relatively low profile and being efficient and inexpensive. Examples of military and commercial applications where such an antenna can be employed abound. State of the art in microwave antennas, and more particularly, microwave antennas having wide angle scanning contains examples of antenna systems of similar capability, but characterized by a high degree of complexity, with expensive electronic components, which translates into costly fabrication.

At microwave frequencies, it is conventional to use slotted waveguide arrays, printed patch arrays, and reflector and lens systems. Conventional slotted planar array antennas have a complicated design, which, in conjunction with the precision and complexity required in the machining, joining, and assembly of such antennas, further limits their use. Printed patch array antennas suffer from inferior efficiency due to their high dissipative losses, particularly at higher frequencies and for larger arrays. Frequency bandwidths for such antennas are typically less than that which can be realized with slotted planar arrays. Sensitivity to dimensional and material tolerances is greater in this type of array due to the dielectric loading and resonant structures inherent in their design. On top of these we have to add the complexity of variable phase or time delay control to the elements, necessary in order to achieve full 3D scanning.

Reflector and lens antennas are generally employed in applications for which planar array antennas are undesirable, and for which the additional bulk and weight of a reflector or lens system is deemed to be acceptable. Reflectors are the least expensive antenna type for a large aperture. The absence of discrete aperture excitation control in traditional reflector and lens antennas limit their effectiveness in low sidelobe and shaped-beam applications. These systems can be scanned mechanically over limited angular regions with varying degrees of success.

This technology could also be applied to consumer electronics applications such as telecommunications (cellular telephone, back-haul, etc.) commercial aircraft, commercial radar, etc. where the distinct performance advantages and small form factor provided by the combination of RF MEMS and silicon germanium (SiGe) or other electronic circuits are desired.

Other traditional attempts involve the use of Reflectarray configurations with diode switches for steering. Reflectarrays are inexpensive and promising structures, and have been known for a long time [Berry, D. G., Malech, R. G. and Kennedy, W. A., "The reflectarray antenna," *IEEE Trans.*, Ant. Propag., vol_AP-11, 1963, pp.646–651], however, when endowed with electronic scanning, in the form of complex arrays of independently controlled pin diodes, they become severely limited due to the complexities introduced by the presence of the DC bias network.

In U.S. Pat. No. 5,864,322, an electronic scan antenna for generating an electrically scanned RF beam in response to an incident RF beam includes a ground plane for reflecting the incident RF beam and a phasing arrangement of plasma structures operatively coupled to the ground plane. Each plasma structure includes gas containing areas which are reflective at the operating frequency range, when ionized. Each ionized plasma area, in cooperation with the ground plane, provides a portion of a composite RF beam which has a phase shift associated therewith. The antenna also includes a control circuit for selectively ionizing the gas containing areas such that the size of each ionized plasma area may be dynamically varied so as to dynamically vary the imparted phase shift. In this manner, the composite RF beam may be electronically scanned.

The latter scheme is essentially a reconfigurable dynamic FLAPS™ antenna, a Reflectarray related technology. The FLAPS™ antenna does not perform an electronic scanning function, and was disclosed in U.S. Pat. No. 4,905,014 to Gonzalez et al., entitled "Microwave Phasing Structures For Electromagnetically Emulating Reflective Surfaces And Focusing Elements Of Selected Geometry," issued on Feb. 27, 1990. This application is incorporated herein by reference.

More recently, in U.S. Pat. No. 5,905,472 [Wolfson, Ronald I., Milroy, William W., Lemons, Alan C. Coppedge, Stuart B., May 18, 1999, Assignee: Raytheon Company], a planar array antenna was presented that uses two distributed ferrite scanning line feeds to feed a planar array antenna. The scanning line feeds couple RF energy to the antenna from opposite sides to form a total of four beams offset in space that each cover different angular scan sectors. The scheme uses a 360 degree gimbal in the second axis, and is claimed to significantly improve on the performance of continuous transverse stub (CTS) antennas and systems. The scanning line feeds and planar array antenna may be designed so that the four scan sectors are contiguous, thereby increasing the angular scan coverage of the antenna at least fourfold. The switching matrix is used to sequentially feed each of four RF ports to effectively produce a single beam that scans over the four contiguous scan sectors. This application is incorporated herein by reference.

SUMMARY OF THE INVENTION

In accordance with one preferred embodiment of the present invention an antenna system includes a radiating element radiating signals through an array of phase-inducing resonant elements for focusing the radiated signals to produce a radiated beam which is scanned by rotating the array of phase of phase-inducing elements.

In accordance with another embodiment the characteristics of transmission through an FSS array of passive elements is combined with the steering behavior afforded by an induced phase gradient of an antenna aperture, for arbitrary polarized fields, and a mechanical fixture (implemented in the form of two rotating multilayered inhomogeneous panels, each layer of which possesses printed FSS element patterns resulting in each individual panel capable of 2-D scanning), to afford the type of aperture phase required to produce linear 3-D scanning. By cascading the two panels and rotating them with respect to each other, a field passing through the composite structure undergoes a phase change related to the vector addition of the two individual phase profile gradients of each plate. This results in 3D scanning. The scanning properties are complemented with the focusing requirements (which can be implemented in the form of an independent focusing multilayered FSS lens structure, or can be compounded with the scanning operation).

The resulting scheme can employ an arbitrary polarized feed illuminating the resulting planar and low profile structure, and resulting in no blockage. The antenna according to one embodiment of the present invention has the extra advantage of reduced complexity with much lower design and production costs than existing antenna systems. The resulting flat and simple 2D and 3D focusing and steering mechanism offers significant advantages over traditional electronic or electromechanical reflectarrays. It is based on well demonstrated concepts, has no feed blockage problems, no electronic switching, it is easy to build and is cheap.

DESCRIPTION OF PREFERRED EMBODIMENTS

According to one embodiment of the present invention, an antenna system comprises a feed horn 11 and a focusing panel 18 radiating signals through a pair of Frequency Selective Surface (FSS) array panels 13 and 15 of arrayed passive elements with the steering behavior afforded by an induced phase gradient of the antenna aperature and a mechanical fixture implemented to rotate the two plates. Each panel 13 or 15 are multi-layered inhomogeneous panels wherein each layer or surface of each panel containers printed FSS element patterns capable of 2-D scanning.

Figure 2:
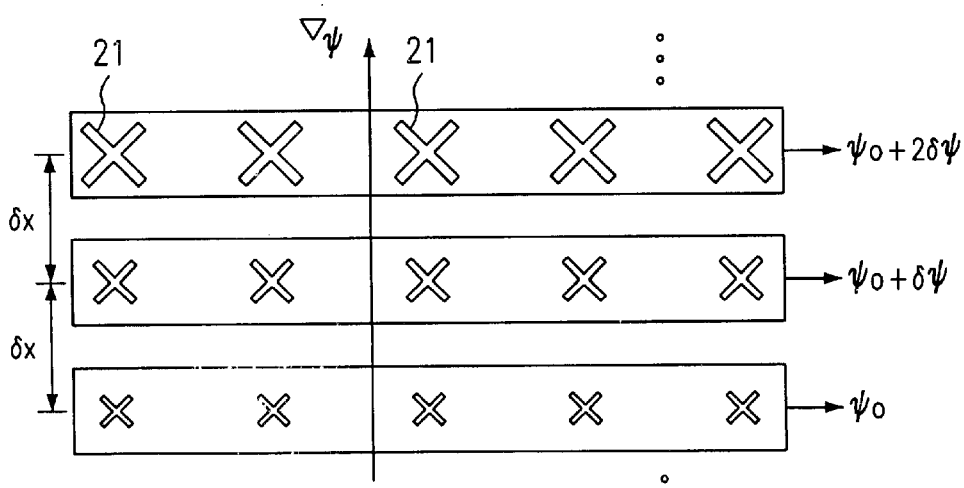
FIG. 2 is a normal view of FSS lens structure illustrating elements with associated phase shifts and phase gradient.

FIG. 2 shows a surface A of one of the panels 13 or 15, which is composed of rows 12 of homogeneous elements 21. FIG. 2 is a normal view of an FSS lens structure showing resonant elements 21 with associated phase shifts and phase gradient. The resonant elements 21 are for the example crossed dipoles. The crossed dipoles on dielectric sheet or surface is similar to that described in the referenced patent U.S. Pat. No. 5,864,322. The elements 21 are between $\lambda/3$ to greater than $\lambda/2$ in length and $\lambda/2$ between elements at the derived resonant frequencies. Each resonant element 21 at the derived resonant frequencies is resonant at a particular frequency. The phase shifts drastically in the neighborhood of resonance. The rows have different size resonant elements which are resonant at a different frequency so it gives a different phase shift to signals that it passes and gives a different phase shift. These frequency selective surface resonant elements 21 may be printed elements such as formed by etching a conductive surfaced dielectric sheet such as Teflon or quartz to form the crossed dipoles. The resonant elements 21 may be other shapes such as patches or be radiating slots. In a preferred embodiment radiating slots are used. They may likewise be formed by etching. In the case of slots the metal surface is etched away leaving slots where the crosses illustrated in FIG. 2. The sizes of the slots and the spacing would change in the same manner as the crosses.

All elements 21 in a given row introduce the same phase on transmission, the values being . . . $\psi O, \psi O+\delta\psi, \psi O+2\delta\psi$. . . , which for a row separation $\delta_\chi$ results in an induced phase gradient $|\nabla_\psi| \sim \delta\psi|\delta_\chi \sim \kappa_t$, for $\kappa_t$, the induced equivalent k(wavenumber) component on the plane of the structure. In the neighborhood of resonance the size gives difference phase. The simulations of this embodiment reveal that arbitrary 0–360 (degrees) phase insertion by a panel with four cascaded elements are possible with little Insertion Loss. For people skilled in the art, the design of such a structure is similar to that usually encountered in filtered stages, and amenable to analysis via standard analytical tools. It should be noted that the scattering elements can be of the dipole type; of the slot type (i.e., perfectly conducting plane with a regular grid of slot elements), or a combination of both. By "dipole" or "slot" we are not referring to just the linear dipole or linear slot of elements, but to arbitrary path definitions on a unit cell (continuous or discontinuous path), as well as arbitrary "slot" profile (such as concentric ellipses).

Figure 3:
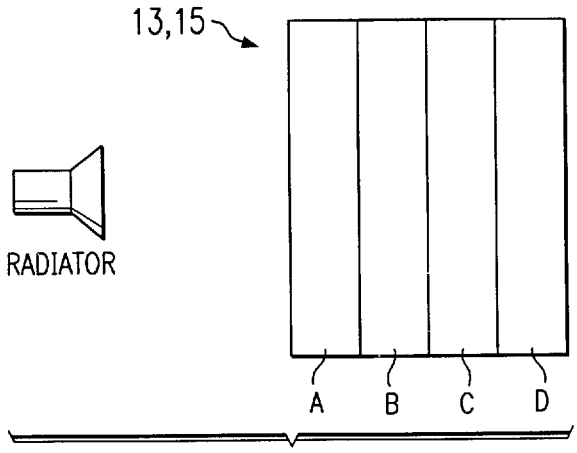
FIG. 3 illustrates an edge view of four layers of array elements in a panel of the system of FIG. 1.
Figure 4:
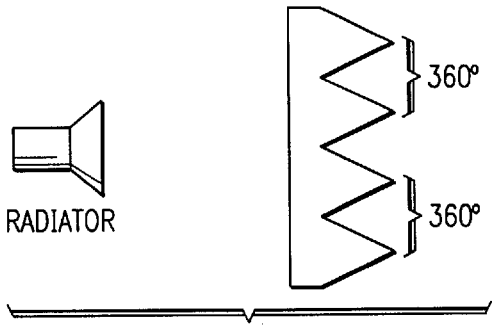
FIG. 4 illustrates a phase front produced by each of the multilayered panels in FIG. 1.

The multilayered structure that makes up a plate 13 or 15 is comprised for example of four identified resonant element sheets A, B, C, D aligned and stacked on top of the other where each sheet or layer provides ±45° phase shift to provide a combined phase. This is illustrated by the edge view of FIG. 3. The four sheets produce a phase front as illustrated in FIG. 4 with effective phase steps of 360° to produce a beam tilt defined by the gradient of this direction. This operates in a manner analogous to that of a Fresnel lens. When this panel is rotated, the beam is tilted in a different direction in one plane.

Figure 5:
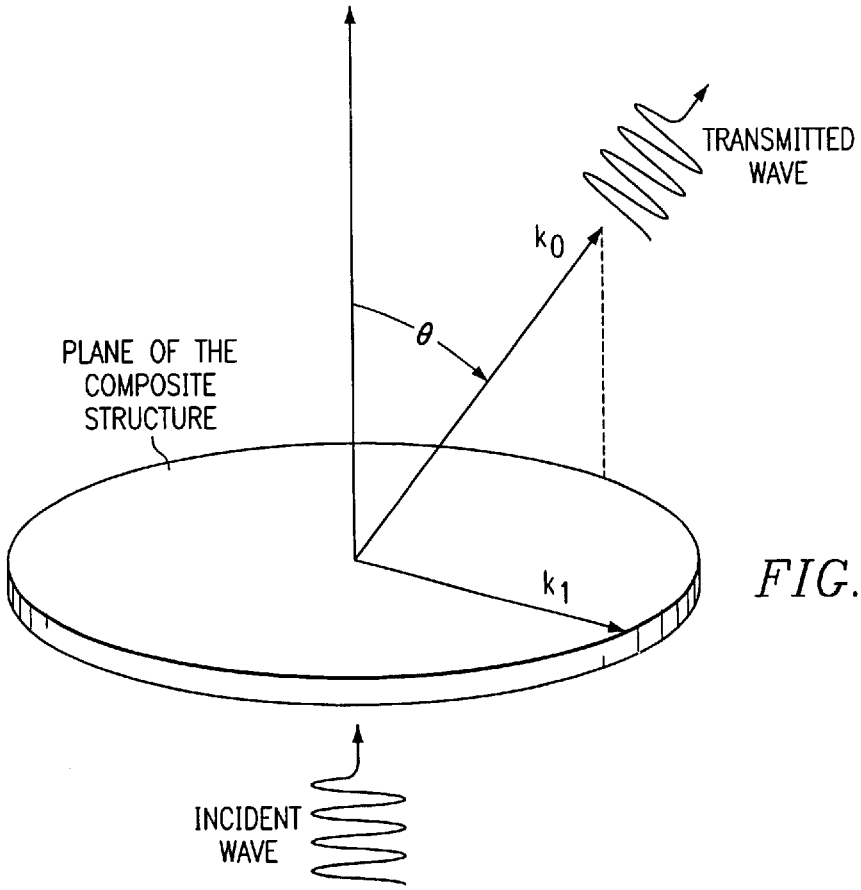
FIG. 5 illustrates scan as a function of $\kappa_t$.

When two layers A and B for example of a similar structure are placed on top of the other, and are aligned, to a very good approximation (given the high degree of transmission of the structure), the induced k on the plane will be (of the composite) twice the individual $\kappa_t$. In other words, the k's will add, but they add vectorially. For instance, if two identical structures are stacked such that their gradients form an angle $2\alpha$ (such as shown in FIG. 5), then the effective $\kappa$ on the plane is $\kappa_t \sim 2|\nabla\psi| \cos(\alpha)$. Thus by varying alpha we control $\kappa_t$, in other words, varying alpha will steer the transmitted beam.

Actually $\kappa_t = \kappa_O \sin(\theta)$ where $\theta$ is the scan angle and is illustrated in FIG. 5. Combining the last two equations we have: $\kappa_O \sin(\theta) = 2|\delta\psi| \cos(\alpha)$ (1). For the sake of illustration, let $\delta\psi = \pi$ (it should be recalled that the profile is implemented in the sense of a zoned lens, i.e., multiples of $2\pi$ are not accounted for) and let $\delta\chi = \lambda_m 2$ where $\lambda_m$ is the wavelength in the material, which is expressible in terms of $\lambda_o$ in free space via $\lambda_m$, $$\frac{\lambda_0}{\sqrt{\varepsilon_{eff}}}.$$

for $\epsilon_{eff}$ the effective permittivity (this is actually immaterial, we just need a number for $\delta_x$) which we assume −3 for a quartz laminate.

The example results in $\sin(\theta) = \sqrt{3} \cos(\alpha)/2$. As $\alpha$ varies from 0° to 90° (gradients in opposition), the beam is scanned from 60° to 0°. The concept as presented is polarization independent and offers explicit scan in elevation. Full 3D steering is achieved by simply rotating the two panels 13 and 15 together. The beam steered position is dependent upon the vector addition of the position of the two panels 13 and 15.

Though focusing can perhaps be integrated with the linear phase profiles, it is much simpler to use an independent 3D panel for focusing. The implementation can also be simplified by employing toothed edges on the rims of the composite panels and using a simple gear to perform the scanning (rotation by angle alpha). This is illustrated in FIG. 6.

Figure 1:
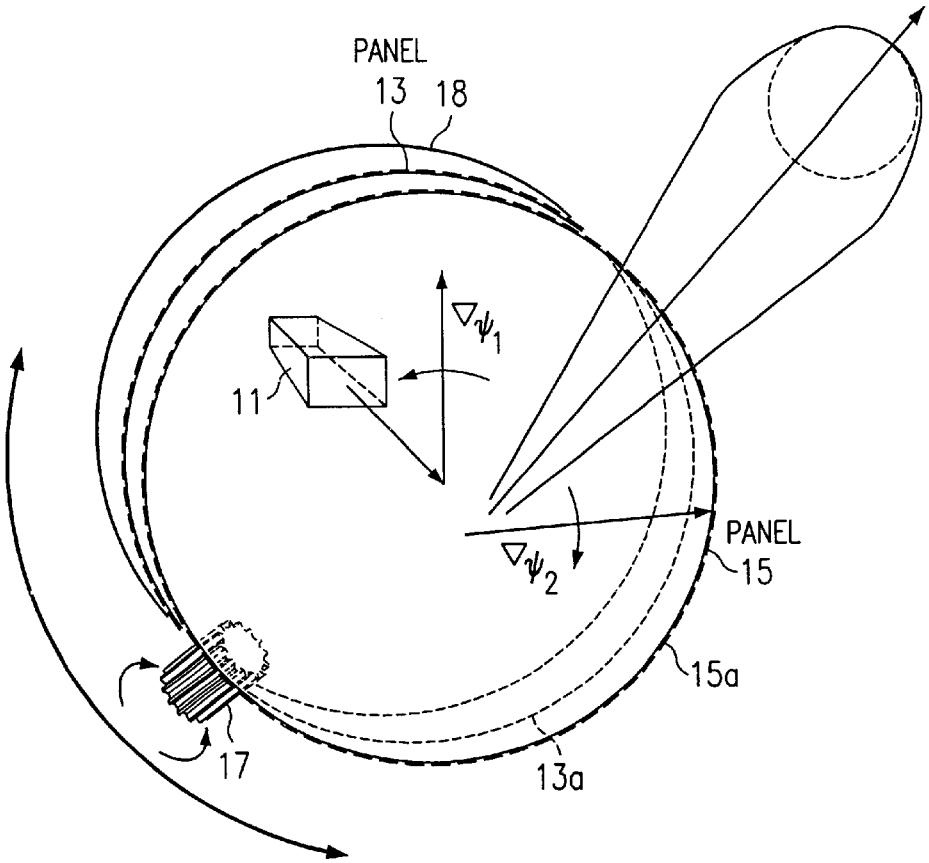
FIG. 1 illustrates an antenna system according to one embodiment of the present invention.
Figure 6:
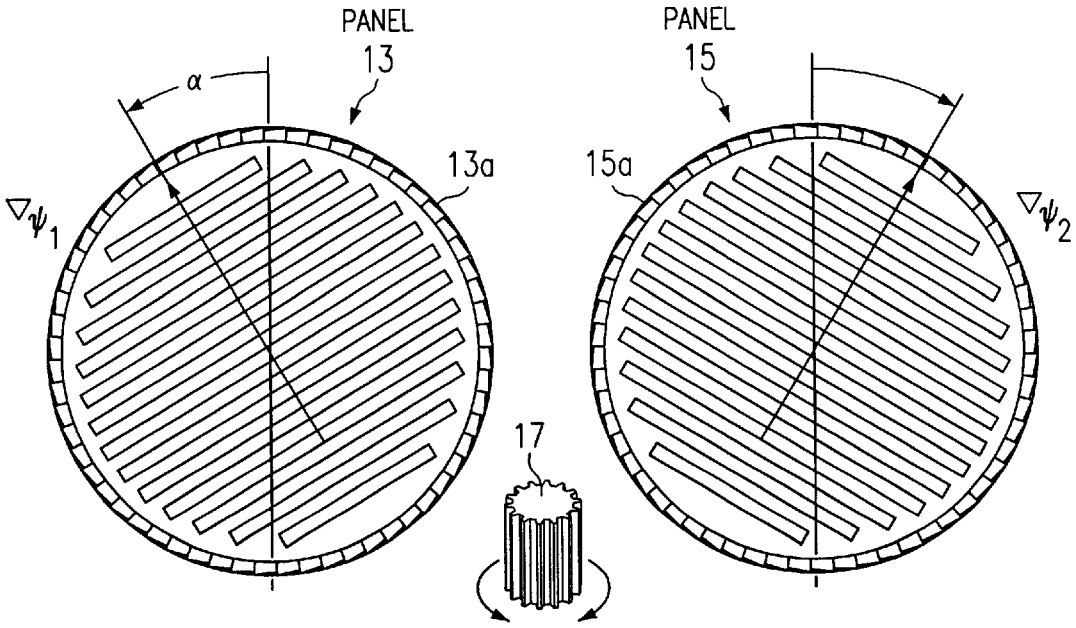
FIG. 6 illustrates phasing panels (multilayered lens sheets) and gear mechanism.
Figure 7:
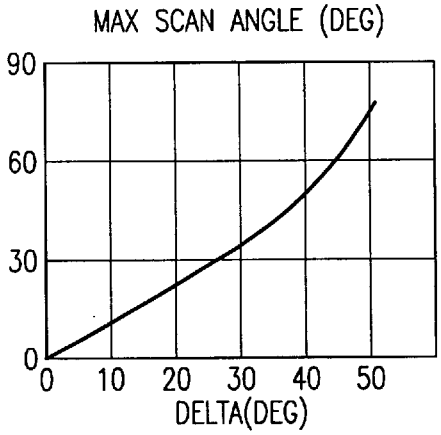
FIG. 7 is a panel of maximum scan angle in degrees vs. phase shift in degrees.

Sketches of these concepts are included in FIGS. 1 and 6. FIG. 6 illustrates the gear mechanism of toothed edges 13*a* and 15*a* on panels 13 and 15 and drive gear 17 coupled to the toothed edges for rotating the panels 13 and 15. FIG. 7 presents data on the maximum scan angle ($\theta$ above for $\alpha$=0) as a function of the phase shift between adjacent rows of elements Equation (1) was used to obtain this curve. This is maximum scan angle for two rows of elements per wavelength in quartz laminate material (eps~3) and "delta" phase shift between adjacent rows.

Figure 8:
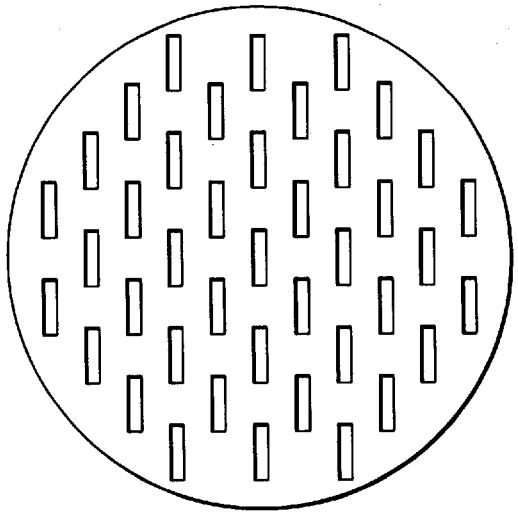
FIG. 8 illustrates a commercially available fixed beam slotted plate array antenna.
Figure 9:
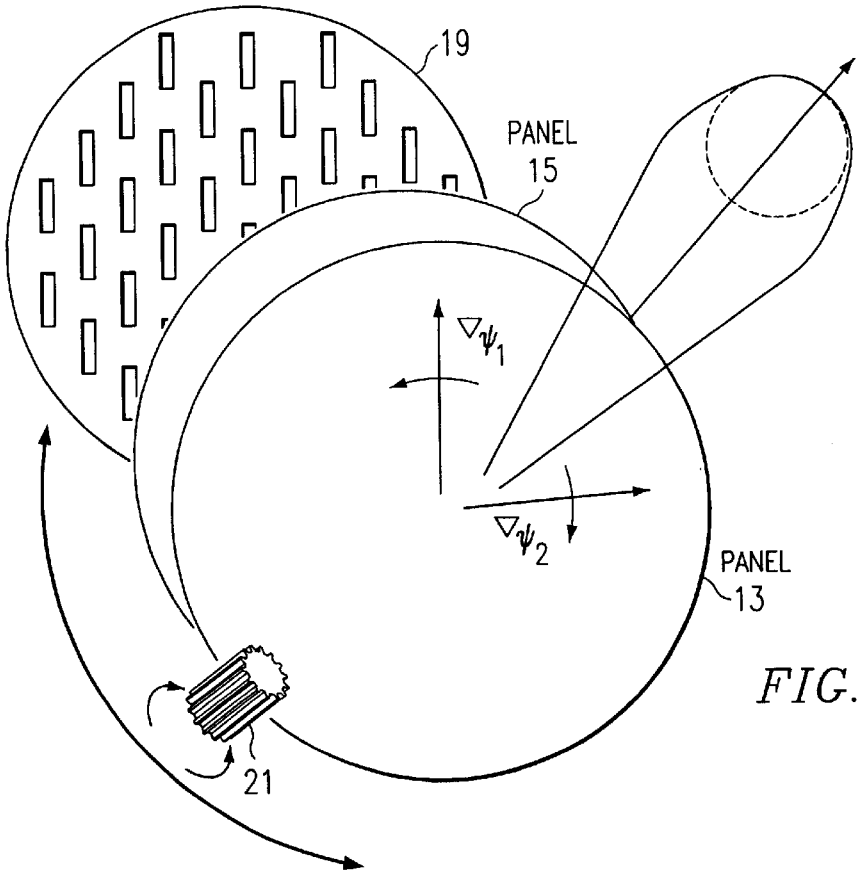
FIG. 9 illustrates dual circular panels with gear mechanism and fixed beam slotted plate array feed.

Even though we have illustrated the concept as illustrated in FIG. 1 with a feed horn 11 and focusing panel 18, the ideal source is a fixed beam slotted plate array antenna. One of these is shown in FIG. 8. These are well developed antennas, commercially available in different sizes and bands. The flat plate array antenna provides us with an aperture of desirable amplitude and phase characteristics. Further, the antenna is pretty thin (a fraction of a wavelength) and relatively lightweight, characteristics which will be preserved as we add the FSS panels for scanning. The separation between the scanning mechanism and the flat plate aperture is not deemed to be critical, however, a distance of ~$\lambda$/4 is probably safe. FIG. 9 illustrates dual circular panels 13 and 15 and a fixed beam slotted plate array feed 19. This slotted array feed 19 can provide equally distributed amplitude and present uniform phase to the panels 13 and 15. The gear mechanism 21 drives the panels 13 and 15 with peripheral teeth 13*a* or 13*b* as illustrated in FIG. 6. Driving both panels 13 and 15 together in the same direction steers the beam in one plane. Driving the panels 13 and 15 in opposite directions with the drive gear 21 between the panels 13 and 15 with the gear 21 near the the periphery of the circular panels 13 and 15 mating with teeth on the broad surface of the panels 13 and 15 near the periphery thereof to rotate the panels in opposite direction to each other to produce 3-D steering. The motion of the panels is simple, and other rotating mechanisms can beused such as belts, axially mounted gears, etc.

Another slotted plate array antenna is known as the Linearly Polarized Radial Line Slot Array (LPRLSA) and is essentially an outward traveling axially symmetric wave (center fed) which couples to properly positioned and oriented slots that radiate power into the air. This is a concept from the 1950's. More recently, circularly polarized versions have been announced (N. Goto, M. Yamamoto, "Circularly Polarized Radial Line Slot Antennas," IECE Technical Report (in Japanese), AP80-57, August 1980, p.43). Any of these antennas are also a good candidates for a feed, resulting in a truly flat final structure.

Figure 10:
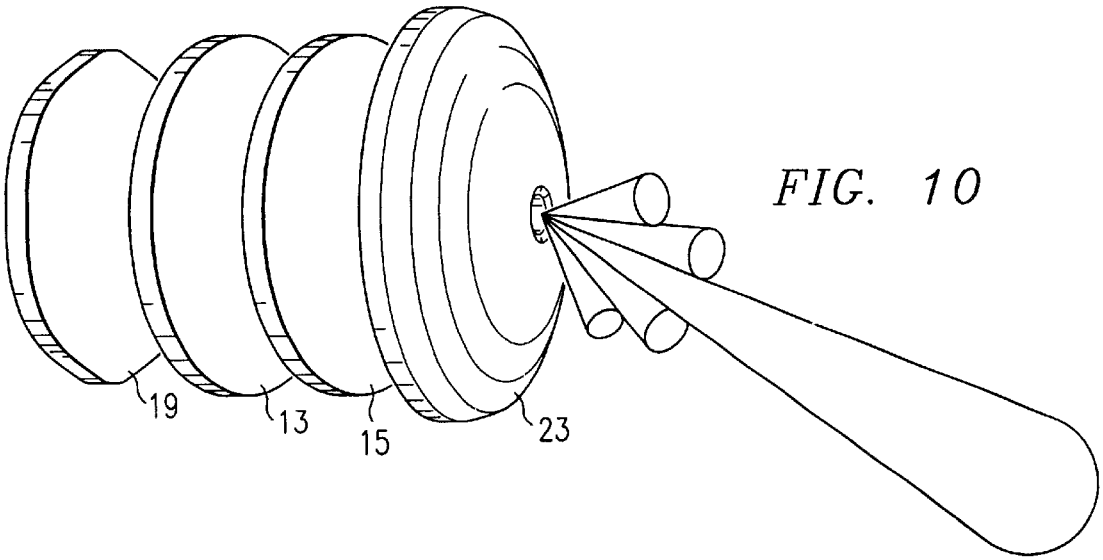
FIG. 10 illustrates the different components of the system of FIG. 9 protected with a radome.

FIG. 10 illustrates the 3D scanning antenna system covered by a radome 23.

If a linear polarization slot array antenna is used, and circular pol is needed, a polarizer can be added (such a polarizer is common knowledge to people skilled in the arts and can be designed by standard analytical techniques).

The above examples have explicitly illustrated the embodiment of the invention with a feed horn, and a fixed beam slotted plate array antenna. The invention is not constraint to those feed elements, and any source could be employed provided the focusing plate is designed to accommodate to the new characteristics of the fields on the aperture. Once again, such a design is routine to people skilled in the arts.

Although the antenna was discussed as if it is was a transmitting antenna, the same principles apply when it is being used as a receiving antenna. It should also be mentioned that the previous description and parameters set forth, by way of example, and not limitation, various component dimensions and design trade-offs in constructing the device.

Our application considers in essence a novel reconfiguration of the effective aperture of an antenna:

Relevant to this discussion is our recent concept of "Planar multi-layered FSS scanning lens structures," which is submitted in parallel with this application, and relates to the use of multilayered Frequency Selective Surface (FSS) structures with a prescribed distribution of Phase insertion resulting in deflection of a transmitted field. By combining two such structures, orthogonal to each other, and with translational motion, phase superposition is achieved and 3D beam scanning results.

The antenna is of significant interest for terrestrial and satellite communications, where it has advantages over more traditional approaches (weight, volume, cost), and can even be employed to track low-earth orbit satellites, and mounted on roof of cars, boats, or even hung on the wall of a house. Other applications can include, fire control systems, air traffic control radar, and forward looking radar automotive systems at 77 GHz.

For military applications, the antenna of the present invention will be applicable to multiple purposes, such as weapons locators and radar, as well as in many platforms, where the large weight and volume limitation problem imposed by more traditional technologies can be alleviated by the use of a flat and lightweight structure.

What is claimed is:

1. A low profile frequency selective scanning antenna comprising:

a radiating element for radiating signals;

a frequency selective surface array panel of phase-inducing transmitting resonant elements for focusing said radiated signals to produce a transmitted arrayed beams and means for rotating said array panel of phase inducing resonant elements to scan said beam.

2. The system of claim 1 wherein said panel has multiple layers of arrays of phase inducing elements.

3. The system of claim 1 including a second frequency selective surface array panel of phase-inducing transmitting resonant elements for focusing said radiated signals to produce a transmitted arrayed beam.

4. The system of claim 3 wherein said means for rotating said elements includes means for rotating said panels.

5. The system of claim 4 wherein said rotating panels contain toothed wheels and gear means to engage the panels to drive the panels.

6. The system of claim 4 wherein said rotating panels are multilayered panels.

7. The system of claim 1 wherein said radiating element is an array of slot radiators.

8. The system of claim 4 wherein said rotating panels are mechanically driven.

9. The system of claim 7 wherein said array of slot radiators are on a flat panel.

US 6,473,057 B2
7 8
* * * * *

UNITED STATES PATENT AND TRADEMARK OFFICE

CERTIFICATE OF CORRECTION

PATENT NO. : 6,473,057 B2
DATED : October 29, 2002
INVENTOR(S) : Cesar Monzon

It is certified that error appears in the above-identified patent and that said Letters Patent is hereby corrected as shown below:

Column 4,
Line 11, after " $\delta\psi$ ", delete "|", and insert -- / --.
Line 55, delete " $\delta\chi = \lambda_m 2$ " and insert -- $\delta\chi = \lambda_m/2$ --.

Signed and Sealed this

Twenty-seventh Day of May, 2003

JAMES E. ROGAN
*Director of the United States Patent and Trademark Office*